US006321580B1

(12) United States Patent
Olson

(10) Patent No.: US 6,321,580 B1
(45) Date of Patent: Nov. 27, 2001

(54) LOCKABLE COVER FOR BATHROOM FIXTURES

(76) Inventor: Gary W. Olson, 3320 Windlass Cir., Anchorage, AK (US) 99516

( * ) Notice: Subject to any disclaimer, the term of this patent is extended or adjusted under 35 U.S.C. 154(b) by 19 days.

(21) Appl. No.: 09/588,098

(22) Filed: Jun. 1, 2000

(51) Int. Cl.[7] ..... B65D 55/14

(52) U.S. Cl. ..... 70/164; 70/163; 70/166; 70/209; 70/237; 292/DIG. 65

(58) Field of Search ..... 70/164, 163, 166, 70/167, 168, 169, 209, 237, 238; 292/DIG. 65; 4/253, 654, 657, 580

(56) References Cited

U.S. PATENT DOCUMENTS 1,689,979 * 10/1928 Tate et al. .
4,131,769 * 12/1978 Davis ..... 379/445
4,577,478 * 3/1986 Economopoulos et al. ..... 70/168
4,763,363 * 8/1988 Lallemand ..... 4/253
5,560,049 * 10/1996 Robinson et al. ..... 4/253
5,581,824 * 12/1996 Crook, Sr. ..... 4/253
5,669,081 * 9/1997 Scherer et al. ..... 4/253
6,108,827 * 8/2000 Espadas ..... 4/253

* cited by examiner

*Primary Examiner*—William A. Cuchlinski, Jr.
*Assistant Examiner*—Olga Hernandez
(74) *Attorney, Agent, or Firm*—Michael J. Tavelia

(57) ABSTRACT

A device that fits over a fixture, such as a toilet. It uses a number of articulated members that align with the rim of the bowl. A center star gear is used to pull all the members inward, tightly against the rim. The members are designed to fit over the rim to ensure a tight fit that is not easily defeated by prying from the underside, for example. A lock is used to prevent removal of the device. Finally, the device can be designed to fit over sinks and urinals as well.

20 Claims, 3 Drawing Sheets

LOCKABLE COVER FOR BATHROOM FIXTURES

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates to lockable covers for bathroom fixtures and particularly to lockable covers used during construction and maintenance operations.

2. Description of Related Art

Construction and remodeling, and maintenance operations of commercial facilities often requires the installation of new bathroom facilities or the shutdown of existing facilities. This means that these facilities do not have a water supply. Inevitably, people (especially in remodeling and maintenance jobs) do not realize that these facilities do not work and use them. Often, this unauthorized use leaves a mess that may exist for a long time before it must be cleaned up manually. Such clean up is not only unpleasant, but may be hazardous for employees who must perform the task.

To prevent such use, various means have been used to prevent people from gaining access to the facilities. Warning signs are also used. These prove ineffective, however. Several types of devices have been designed to lock the top of toilets, for example, to prevent access. Examples are found in the following U.S. Patents. U.S. Pat. No. 733,787 to Woodruff discloses a cover for a toilet that uses a locking bar that fits under the rim of the toilet. The locking bas is bolted to a lid that seals the toilet. The problem with this design is that it uses the rim of the toilet to secure the locking bar. A person trying to gain access to the toilet can break or damage the toilet by prying on the lid. Moreover, a determined person can break the lock shown on the device and then defeat the mechanism entirely. U.S. Pat. No. 735,927 to Woodruff discloses a wire lip mechanism that fits over the toilet lid. A chain and lock secure these wire lips to the lid and then to the toilet itself. This system ostensibly prevents the toilet lid from being raised. However, this device can be easily defeated with a pry tool. Use of such a tool can damage the toilet as well. Moreover, the chain can be cut, defeating the purpose of the device. U.S. Pat. No. 906,077 to Spencer also uses a holding lever that is secured to the underside of the bowl rim. Here, access to the bolt is made more difficult. However, because the device us secured to the bowl rim, it is possible to damage the bowl in attempting to remove the device. U.S. Pat. No. 1,169,711 to Zimmers uses a locking bar that is mounted under a toilet seat. A second bar is attached to the lid. When the lid id closed, a lock secures it in place. The problem with this design is that it requires the toilet, the lid and the seat to be modified. Moreover, it can cause damage to the fixture if a user pries on the lid in an attempt to remove it. U.S. Pat. No. 1,793,815 to McCann discloses a box structure that fits over fixtures. These box covers are then secured in place with chains and locks. The problem here is that the chains and locks are accessible and can be cut. Thus, the device can be defeated rather easily. U.S. Pat. No. 2,404,124 to Des Roches teaches a device that uses flexible straps to secure a toilet lid. The problem here is that the straps are made of a fabric. As such, a determined person can easily cut the straps and defeat the device. U.S. Pat. No. 3,346,888 to Paysinger teaches a clamp that secures a cover using a bar that fits under the bowl rim of a toilet. As discussed above, these types of devices may prevent access, but often result in damage to the fixture. Finally, U.S. Pat. No. 5,682,776 to Burt is a device designed to prevent access to a toilet by small children. Although the device secures the toilet lid, it is designed to be easily operated by an adult.

The problems with these devices fall into three categories. While some appear to effective secure a fixture, they are prone to cause damage to the fixture is a person makes a concerted effort to defeat the device. The second problem with these devices is that some are easily defeated. They use chains or fabric straps that are exposed and vulnerable to cutting or breaking. Finally, some of these devices require modification of the lid, and seat. While useful, they require replacement of those parts when the fixture is ready for use.

BRIEF SUMMARY OF THE INVENTION

The instant invention overcomes these problems. It is a device that fits over a fixture, such as a toilet. It uses a number of articulated, conformable members that align with the rim of the bowl. A center star gear is used to pull all the members inward, to compress them tightly against the rim. The members are designed to fit over the rim to ensure a tight fit that is not easily defeated by prying from the underside, for example. Once in place, the tightening crank is removed and a lock is installed to prevent removal of the device. Finally, the device can be designed to fit over sinks and urinals as well.

DETAILED DESCRIPTION OF THE INVENTION

Figure 1:
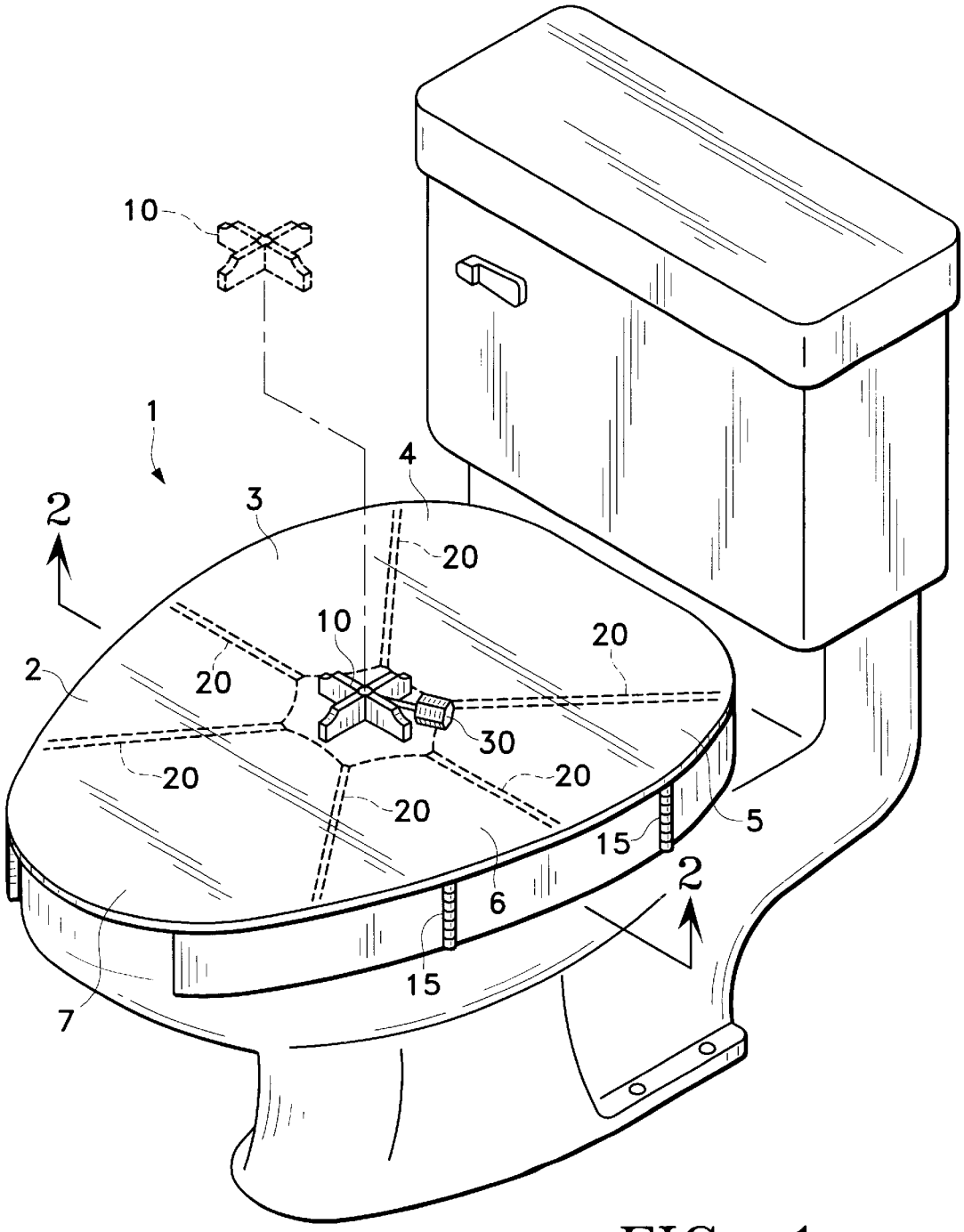
FIG. 1 is a perspective view of the invention installed on a commode.

Referring now to FIG. 1, the preferred embodiment of the invention is shown. The device 1 has a number of articulated, conformable members 2–7 that align with the rim 100 of a toilet bowl 101. See FIG. 2. The members are shaped to fit over the rim to ensure a tight fit that is not easily defeated by prying from the underside, for example. The members have hinges 15 as shown that allow them to conform to the shape of the fixture. As shown in the figures, these hinges may be true pin type hinges, or they can be formed by notching the articulated panels as shown.

The members are also connected by a number of rods 20. The rods extend inward from the inside walls of the members to a center star gear 10. Initially, the members are fully extended to fit over the bowl rim easily. As the star gear 10 is turned, it pulls all the members 2–7 inward, compressing the rubber lining 25 tightly against the rim 100. The crank 10 is removed and a lock 30 is attached to the star gear to prevent removal of the device. The device is removed by unlocking the star gear, loosening up the members, by turning the star gear in the opposite direction, and then removing the device from the bowl.

Figure 2:
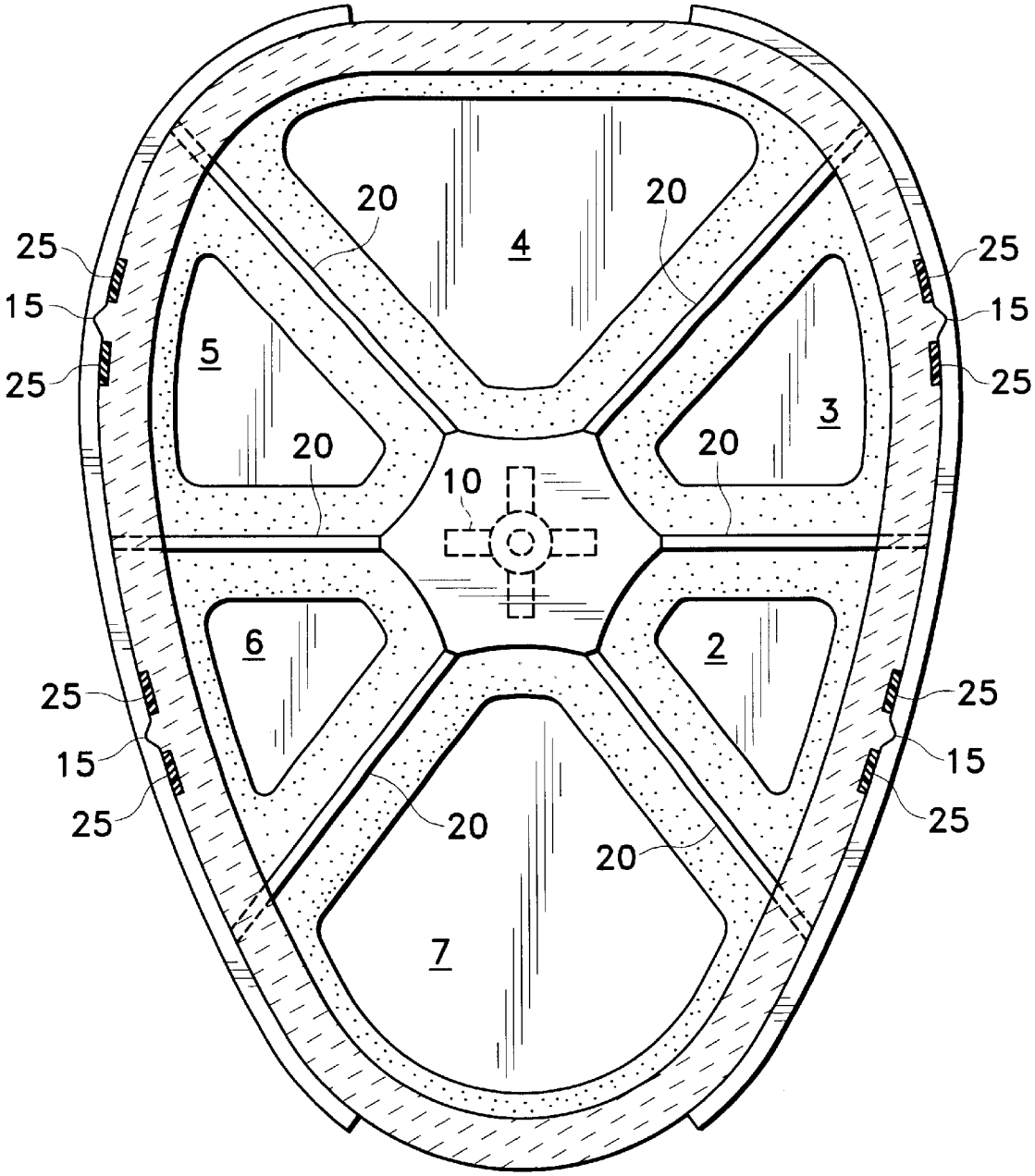
FIG. 2 is a sectional view of the invention in place on a commode, taken along the lines 2—2 of FIG. 1.

The device is made of high strength plastic to ensure that it prevents entry into the fixture. Moreover, it is designed to fit tightly around the rim of the fixture, using a compression fit, to prevent a person from prying it off. As shown in FIG. 2, the compression fit is achieved using a set of compression pads 25 as shown.

Figure 3:
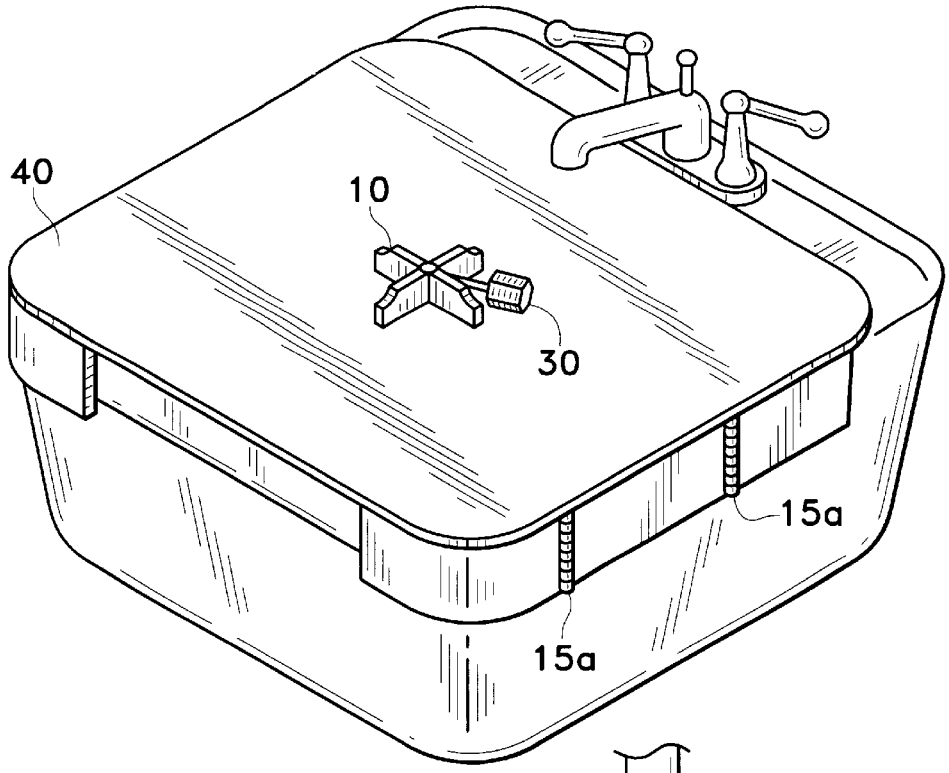
FIG. 3 is a perspective view of a second embodiment of the invention, in place on a sink.

FIG. 3 shows a second embodiment 40 of the device in place in a sink. This unit is designed exactly as the first embodiment, except for its shape.

Figure 4:
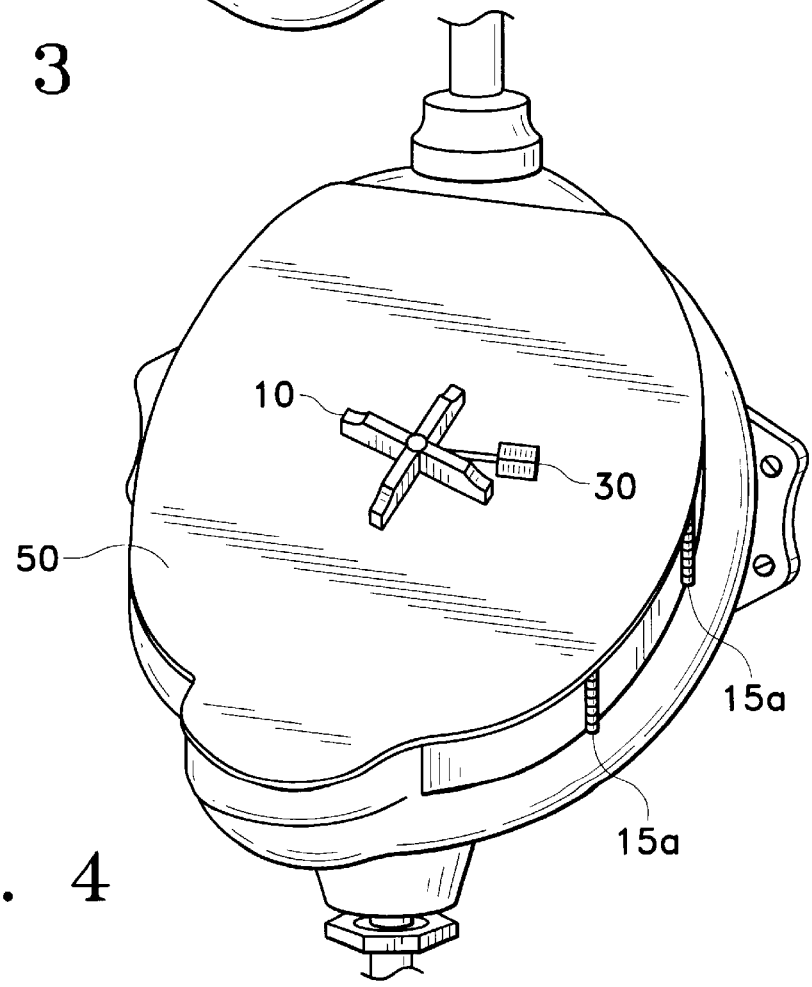
FIG. 4 is a perspective view of a third embodiment of the invention, in place on a urinal.

FIG. 4 shows a third embodiment 50 that is placed over a urinal. As before, this embodiment has similar construction except for the shape.

It is possible to modify the shape of the device to accommodate any shape of fixture. The critical factor is that the device is designed to fit tightly around the perimeter of the fixture to prevent unauthorized access.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A lockable cover for bathroom fixtures comprising:

a) a plurality of articulated hinged, said plurality of articulated hinged members operably attached together and shaped to fit around a perimeter of a bathroom fixture;

b) a plurality of rods, operably attached to said plurality of articulated hinged members; and c) a means for engaging said plurality of rods to cause said plurality of rods to pull said plurality of articulated hinged members tightly against said bathroom fixture, such that said bathroom fixture is closed to use.

2. The lockable cover for bathroom fixtures of claim 1 further comprising a compressible gasket, attached to said plurality of articulated hinged members, such that said compressible gasket is compressed when said plurality of articulated hinged members are pulled tightly against said bathroom fixture.

3. The lockable cover for bathroom fixtures of claim 1 further comprising a lock.

4. The lockable cover for bathroom fixtures of claim 1 wherein the means of engaging said plurality of rods comprises a star gear and a handle.

5. The lockable cover for bathroom fixtures of claim 4 wherein the handle is removable.

6. The lockable cover for bathroom fixtures of claim 1 wherein the bathroom fixture is a toilet.

7. The lockable cover for bathroom fixtures of claim 1 wherein the bathroom fixture is a urinal.

8. The lockable cover for bathroom fixtures of claim 1 wherein the bathroom fixture is a sink.

9. A lockable cover for bathroom fixtures comprising:

a) a plurality of articulated hinged members, each of said plurality of articulated hinged member shaving a horizontal top plate and a side wall, extending downwardly from said horizontal top plate, said plurality of articulated hinged members operably attached together and shaped to fit around a perimeter of a bathroom fixture;

c) a plurality of rods, operably attached to said plurality of articulated hinged members; and d) a means for engaging said plurality of rods to cause said plurality of rods to pull said plurality of articulated hinged members tightly against said bathroom fixture.

10. The lockable cover for bathroom fixtures of claim 9 further comprising a compressible gasket, attached to said plurality of articulated hinged members, such that said compressible gasket is compressed when said plurality of articulated hinged members are pulled tightly against said bathroom fixture.

11. The lockable cover for bathroom fixtures of claim 9 further comprising a lock.

12. The lockable cover for bathroom fixtures of claim 9 wherein the means of engaging said plurality of rods comprises a star gear and a handle.

13. The lockable cover for bathroom fixtures of claim 12 wherein the handle is removable.

14. The lockable cover for bathroom fixtures of claim 9 wherein the bathroom fixture is a toilet.

15. The lockable cover for bathroom fixtures of claim 9 wherein the bathroom fixture is a urinal.

16. The lockable cover for bathroom fixtures of claim 9 wherein the bathroom fixture is a sink.

17. A lockable cover for bathroom fixtures comprising:

a) a plurality of articulated hinged members, each of said plurality of articulated hinged member shaving a horizontal top plate and a side wall, extending downwardly from said horizontal top plate, each horizontal top plate having a distal end;

b) a pivotable joint means, operably attached to the distal ends of each of said plurality of articulated hinged members, such that said plurality of articulated hinged members are operably attached together and shaped to fit around a perimeter of a bathroom fixture;

c) a plurality of rods, operably attached to said plurality of articulated hinged members;

d) a star gear, operably attached to said pivotable joint means and to said plurality of rods, whereby when said star gear is turned, said star gear causes said plurality of rods to pull said plurality of articulated hinged members tightly against said bathroom fixture; and e) an operating handle, attached to said star gear.

18. The lockable cover for bathroom fixtures of claim 17 further comprising a compressible gasket, attached to said plurality of articulated hinged members, such that said compressible gasket is compressed when said plurality of articulated hinged members are pulled tightly against said bathroom fixture.

19. The lockable cover for bathroom fixtures of claim 17 further comprising a lock, operably attached to said star gear.

20. The lockable cover for bathroom fixtures of claim 17 wherein the operating handle is removable.

* * * * *